United States Patent [19]

Frank

[11] 4,373,734

[45] Feb. 15, 1983

[54] DISK THROWING GAME

[76] Inventor: Charles E. Frank, 1759 Chancery #3, Memphis, Tenn. 38116

[21] Appl. No.: 269,327

[22] Filed: Jun. 1, 1981

[51] Int. Cl.[3] ..... A63B 67/06; A63B 63/00

[52] U.S. Cl. ..... 273/411; 273/401

[58] Field of Search ..... 273/411, 348, 398, 400, 273/401, 402, 424, 425, 350

[56] References Cited

U.S. PATENT DOCUMENTS

| | | | |
|---|---|---|---|
| 1,433,437 | 10/1922 | Wakeham | 273/400 |
| 2,126,245 | 8/1938 | Darby | 273/400 X |
| 2,247,852 | 7/1944 | Saunders | 273/348 X |
| 2,545,615 | 3/1951 | Hatley | 273/411 X |
| 2,607,591 | 8/1952 | Tilley | 273/342 |
| 2,822,176 | 2/1958 | Robes | 273/411 X |
| 3,731,930 | 5/1973 | Jeandron | 273/425 X |
| 3,822,883 | 7/1974 | De Vos | 273/411 X |
| 3,895,801 | 7/1975 | Baird | 273/350 |

FOREIGN PATENT DOCUMENTS

| | | | |
|---|---|---|---|
| 1046834 | 7/1953 | France | 273/400 |

OTHER PUBLICATIONS

Washington Post, Mar. 30, 1979, p. 41.

*Primary Examiner*—William H. Grieb

*Attorney, Agent, or Firm*—Walker & McKenzie

[57] ABSTRACT

A game which involves two opposing teams attempting to score points by, in general, throwing a flying disk or the like into one or more goals. The goals are positioned adjacent a playing field. The playing field is divided into various areas by appropriate markings. The members of the two opposing teams are allowed to perform specific activities such as running with the disk, throwing the disk at the goals, or the like in each area of the playing field.

11 Claims, 5 Drawing Figures

DISK THROWING GAME

BACKGROUND OF THE INVENTION

1. Field of the Invention

This invention relates generally to games which cause the players thereof to be physically active and more specifically to such games which involve attempts to score points by throwing an object in a specified manner on a playing field.

2. Description of the Prior Art

Heretofore, various games in which the players thereof attempt to score points by throwing an object in a specified manner on a playing field have been developed. Darby, U.S. Pat. No. 2,126,245 discloses a disk scaling game in which a flying disk is thrown into a basket or the like. Hatley, U.S. Pat. No. 2,545,615 discloses an aerial projectile game in which a ball or the like is thrown from a divided playing field through a goal. Tilley, U.S. Pat. No. 2,607,591 discloses a ball game in which a ball is thrown into a target field which is encircled by a net or the like. Robes, U.S. Pat. No. 2,822,176 discloses a game in which an aerial disk is thrown back and forth between the players of the game on a playing field which is divided into opposing playing areas. Jeandron, U.S. Pat. No. 3,731,930 discloses a game in which a projectile is pitched into a target pocket in a resilient pad. De Vos, U.S. Pat. No. 3,822,883 discloses a game in which an aerial projectile is thrown from a playing field which is divided into offensive and defensive areas into a target. Baird, U.S. Pat. No. 3,895,801 discloses a game to be played on a body of water in which a projectile is thrown through a floating target. None of the above patents suggest or disclose the present invention.

SUMMARY OF THE INVENTION

The game of the present invention involves first and second opposing teams attempting to score points by throwing a flying disk or the like in a desired manner. The game includes, in general, goal means for selectively receiving a flying disk or the like thrown by one of the members of the first and second opposing teams and playing field means positioned adjacent the goal means for controlling the action of the first and second opposing teams during the playing of the game.

The goal means includes, in general, a hollow body member having at least one opening therein of a shape which allows the flying disk or the like to enter into the interior of the body member therethrough. The playing field means includes a serving area for allowing one member of one of the first and second opposing teams to introduce a flying disk or the like into the game by throwing the disk to another member of the first or second opposing teams. The playing field means includes a player interaction area adjacent the serving area for allowing one of the members of the first or second opposing teams to catch the disk as the disk is thrown from the serving area and for allowing the members of the first and second opposing teams to interact with one another in a manner in which one of the first and second opposing teams attempts to move the disk towards the goal means while the other of the first and second opposing teams attempts to prevent the disk from being moved toward the goal means. The playing field means includes a shooting area adjacent the player interaction area for allowing one of the members of the first or second opposing teams to throw the disk at the opening in the body member of the goal means. The playing field means also includes a shot-blocking area intermediate the shooting area and the goal means for allowing the members of one of the first or second opposing teams to block the throw of the disk from the shooting area to the goal means.

DESCRIPTION OF THE PREFERRED EMBODIMENT

Figure 1:
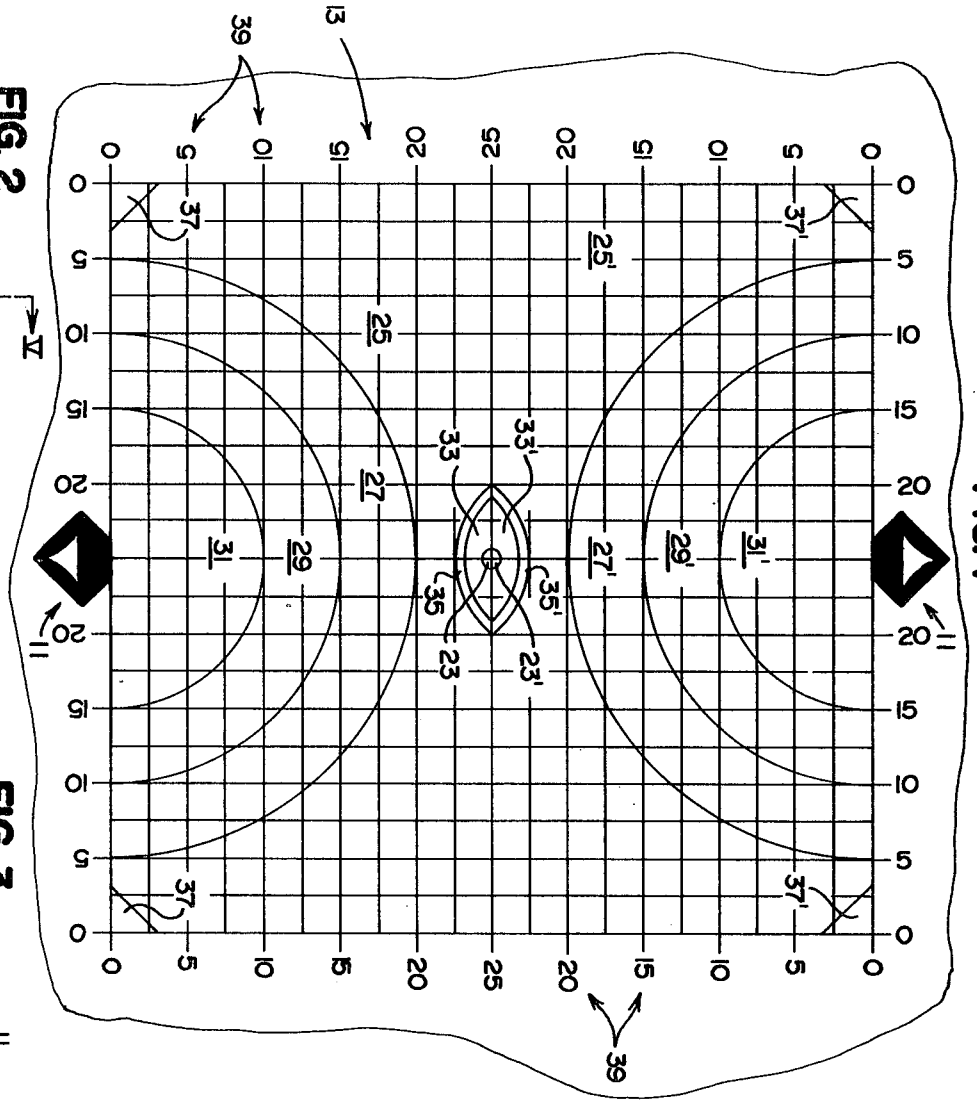
FIG. 1 is a top plan view of the playing field means of the game of the present invention with goal means located at opposite ends thereof.
Figure 2:
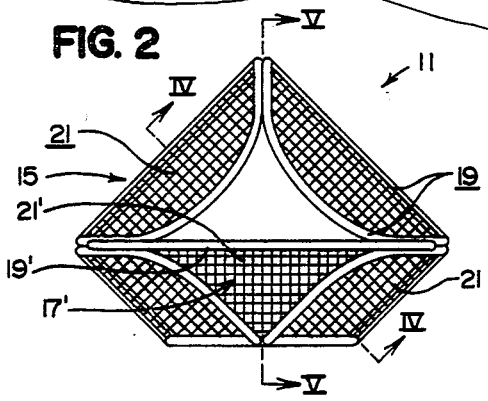
FIG. 2 is a top plan view of a goal means of the game of the present invention.
Figure 3:
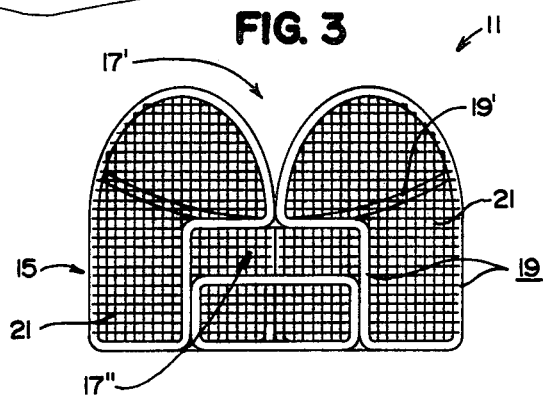
FIG. 3 is a front elevational view of a goal means of the game of the present invention.
Figure 4:
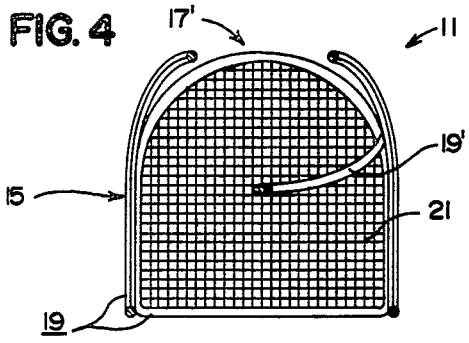
FIG. 4 is a sectional view of a goal means of the game of the present invention as taken on line IV—IV of FIG. 2.
Figure 5:
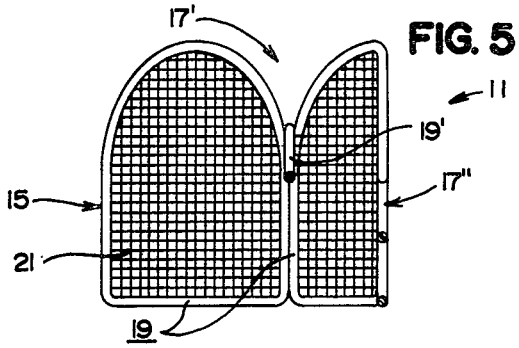
FIG. 5 is a sectional view of a goal means of the game of the present invention as taken on line V—V of FIG. 2.

The game of the present invention includes, in general, one or more goal means 11 (two being shown in FIG. 1 of the drawings) and a playing field means 13 divided into various areas by appropriate markings in any manner well-known to those skilled in the art (e.g., by paint, chalk or the like). The concept of the game of the present invention is for one of two opposing teams to attempt to score points generally by throwing a flying disk or the like (e.g., a flying disk such as sold under the Trademark "Frisbee") into a goal means 11 while the other team attempts to prevent the flying disk or the like from going into the goal means 11.

Each goal means 11 includes a hollow body member 15 having at least one opening 17 therein of a shape which allows the flying disk or the like to enter into the interior of the body member 15 therethrough (see, in general, FIGS. 2, 3, 4 and 5). The body member 15 preferably includes a skeletal frame 19 formed of metal tubing or the like in a shape substantially as shown in the drawings and constructed in any manner that should be apparent to those skilled in the art. That, is, the skeletal frame 19 may consist of various individual lengths of metal tubing manually bent into the desired shape and welded or bolted together. The body member 15 of the goal means 11 also may include a netlike cover 21 attached to the skeletal frame 19 in any manner well-known to those skilled in the art (e.g., by tying or the like). The netlike cover 21 may have a first, or top, opening 17' therethrough adjacent the uppermost portion of the skeletal frame 19 and may have a second, or front, opening 17" therethrough adjacent the forward-most portion of the skeletal frame 19. The first and second openings 17', 17" are of a shape which allows the flying disk or the like to pass therethrough. It should be noted that more than one such front opening 17" may be provided through the netlike cover 21. For example, the goal means 11 may be constructed with a top opening 17' and one front opening 17" as shown in FIGS. 2, 3, 4 and 5; with a top opening 17' and two front openings 17"; with a top opening 17' and no front openings 17"; or with one or more front openings 17" and no top opening 17'. The skeletal frame 19 may include a cross-bar member 19' substantially centered beneath the first opening 17'. The netlike cover 21 may include a netlike portion 21' attached to the crossbar member 19' and to other portions of the skeletal frame 19.

The playing field means 13 includes at least one serving area 23 for allowing one member of one of the first and second opposing teams to introduce a flying disk or the like into the game by throwing the disk or the like to another member of the first or second opposing team. The playing field means 13 also includes at least one player interaction area 25 adjacent the serving area 23 for allowing one of the members of the first or second opposing teams to catch the disk or the like as the disk or the like is thrown from the serving area 23 and for allowing the members of the first and second opposing teams to interact with one another in a manner in which one of the first and second opposing teams attempt to move the disk or the like towards the goal means 11 while the other of the first and second opposing teams attempt to prevent the disk or the like from being so moved toward the goal means 11. The playing field means 13 also includes at least one shooting area 27 adjacent the player interaction area 25 for allowing one of the members of the first or second opposing teams to throw the disk or the like at the openings 17', 17" in the body member 15 of the goal means 11. The playing field means 13 also includes at least one shot-blocking area 29 intermediate the shooting area 27 and the goal means 11 for allowing the members of one of the first or second opposing teams to block the throw of the disk or the like from the shooting area 27 to the goal means 11.

The playing field means 13 may include at least one first restricted area 31 intermediate the shot-blocking area 29 and the goal means 11 for preventing members of the first and second opposing teams from coming closer than the shot-blocking area 29 to the goal means 11. The playing field means 13 may also include at least one second restricted area 33 intermediate the serving area 23 and the player interaction area 25 for preventing all members of the first and second opposing teams except the member in the serving area 23 from coming closer than the player interaction area 25 to the serving area 23. Preferably, the player interaction area 25 includes a boundary portion 35 adjacent the second restricted area 33 and set off from the remainder of the player interaction area 25 by appropriate markings for reasons which will hereinafter become apparent. Additionally, the player interaction area 25 of the playing field means 13 preferably includes at least one but preferably two base-like portions 37 set apart from the remainder of the player interaction area 25 by appropriate markings for reasons which will hereinafter become apparent.

The first restricted area 31 is preferably in the shape of a half of an imaginary circle with the goal means 11 located at the center of the imaginary circle (see FIG. 1). Likewise, the shot-blocking area 29 is preferably in the shape of a half of an annular ring about the outer edge of the first restricted area and the shooting area 27 is preferably in the shape of a half of an annular ring about the outer edge of the shot-blocking area 29. The serving area 23 of the playing field means 13 is also preferably in the shape of a half of an imaginary circle with the second restricted area 33 being in the shape of substantially a half of an elliptical ring about the outer edge of the serving area 23 and with the boundary portion 35 of the player interaction area 25 being in the shape of substantially a half of an elliptical ring about the outer edge of the second restricted area 33 substantially as shown in FIG. 1.

Preferably, the playing field means 13 consists of two halves with one half being the mirror image of the other half. That is, the playing field means 13 preferably includes a second serving area 23', a second player interaction area 25', a second shooting area 27', a second shot-blocking area 29', a second first restricted area 31', a second second restricted area 33', a second boundary portion 35', and second base-like portions 37'.

The playing field means 13 is preferably 50 yards square. The playing field means 13 may be divided into zones or the like by appropriate markings and indicia 39 may be provided to identify the zones.

While the game of the present invention may be played in various ways, one preferred way is as follows: At the start of the game, one player from each of the first and second opposing teams will throw the disk or the like from one of the base-like portions 37 towards the serving area 23 which acts as a "bull's-eye". The team of the player who throws the disk or the like closest to the serving area 23 will bring the disk or the like into play from the serving area 23. It should be noted that certain rules may be applied to the throwing of the disk or the like from the base-like portions 37. When it is determined which team is to bring the disk or the like into play, a bell will sound and eight players from each team will line up on the boundary portion 35 of the player interaction area 25 facing the goal means 11. A player of the team to bring the disk or the like into play will throw the disk or the like from the serving area 23 to one of his teammates in the player interaction area 25. This player will then throw the disk or the like to another of his teammates thereby moving the disk or the like into the shooting area 27. When a player with the disk enters the shooting area 27, he may then throw the disk or the like towards the goal means 11 in an attempt to make the disk or the like go through one of the openings 17 in the goal means 11 thereby scoring points for his team. The defensive team will attempt to block this throw and may enter the shot-blocking area 29 in an attempt to do so. Various specific rules may be made concerning the interaction of the players and the like.

Although the invention has been described and illustrated with respect to a preferred embodiment thereof, it is not to be so limited since changes and modifications may be made therein which are within the full intended scope of the invention.

I claim:

1. A game which involves first and second opposing teams attempting to score points by throwing a flying disk in a desired manner, said game comprising:

(a) goal means for selectively receiving a flying disk thrown by one of the members of the first or second opposing teams, said goal means including a hollow body member having at least one opening therein of a shape which allows the flying disk to enter the interior of said body member therethrough; and (b) playing field means positioned adjacent said goal means for controlling the action of the first and second opposing teams during the playing of said game, said playing field means including a serving area for allowing one member of one of the first or second opposing teams to introduce a flying disk into said game by throwing the disk to another member of the first or second opposing teams, said playing field means including a player interaction area adjacent said serving area for allowing one of the members of the first or second opposing teams to catch the disk as the disk is thrown from said serving area and for allowing the members of the first and second opposing teams to interact with one another in a manner in which one of the opposing teams attempts to move the disk toward said goal means while the other of the opposing teams attempts to prevent the disk from being moved toward said goal means, said playing field means including a shooting area adjacent said player interaction area for allowing one of the members of the first or second opposing teams to throw the disk at said opening in said body member of said goal means, said playing field means including a shot-blocking area intermediate said shooting area and said goal means for allowing the members of one of the first or second opposing teams to block the throw of the disk from said shooting area to said goal means.

2. The game of claim 1 in which said body member of said goal means includes a skeletal frame and includes a netlike cover for being attached to said skeletal frame, said netlike cover having a first opening adjacent the uppermost portion of said skeletal frame and having a second opening adjacent the forwardmost portion of said skeletal frame, said first and second openings being of a shape which allows the flying disk to pass therethrough.

3. The game of claim 1 in which said playing field means includes a first restricted area intermediate said shot-blocking area and said goal means for preventing members of the first and second opposing teams from coming closer than said shot-blocking area to said goal means.

4. The game of claim 3 in which said first restricted area is in the shape of a half of a circle with said goal means located at the center of said imaginary circle, in which said shot-blocking area is in the shape of a half of an annular ring about the outer edge of said first restricted area, and in which said shooting area is in the shape of a half of an annular ring about the outer edge of said shot-blocking area.

5. The game of claim 4 in which said playing field means includes a second restricted area intermediate said serving area and said player interaction area for preventing all members of the first and second opposing teams except the member in said serving area from coming closer than said player interaction area to said serving area.

6. A game which involves first and second opposing teams attempting to score points by throwing a flying disk in a desired manner, said game comprising:

(a) first and second goal means for selectively receiving a flying disk thrown by one of the members of the first or second opposing teams, each of said first and second goal means including a hollow body member having at least one opening therein of a shape which allows the flying disk to enter into the interior of said body member therethrough; and (b) playing field means positioned adjacent and intermediate said first and second goal means for controlling the action of the first and second opposing teams during the playing of said game, said playing field means including first and second serving areas, each of said first and second serving areas allowing one member of one of the first or second opposing teams to introduce a flying disk into said game by throwing the disk to another member of the first or second opposing teams, said playing field including first and second player interaction areas adjacent said first and second serving areas respectively, said first and second player interaction areas allowing one of the members of the first or second opposing teams to catch the disk as the disk is thrown from said first or second serving area and allowing the members of the first and second opposing teams to interact with one another in a manner in which one of the opposing teams attempts to move the disk towards one of said goal means while the other of the opposing teams attempts to prevent the disk from being moved toward said goal means, said playing field including first and second shooting areas adjacent said first and second player interaction areas respectively, said shooting areas allowing one of the members of the opposing teams to throw the disk at said openings in said body members of one of said goal means, said playing field means including first and second shot-blocking areas intermediate said first and second shooting areas and said first and second goal means respectively, said shot-blocking areas allowing the members of one of the opposing teams to block the throw of the disk from said shooting areas to one of said goal means.

7. The game of claim 6 in which said playing field includes first and second first restricted areas intermediate said first and second shot-blocking areas and said first and second goal means respectively for preventing members of the opposing teams from coming closer than said shot-block areas to said goal means, and in which said playing field means includes first and second second restricted areas intermediate said first and second serving areas and said first and second player interaction areas respectively for preventing all members of the opposing teams except the member who is to throw the disk from said serving areas from coming closer than said player interaction areas to said serving areas.

8. The game of claim 7 in which said playing field means is in the shape of a square, in which each of said first and second serving areas are in the shape of a half of a circle and are located substantially in the center of said playing field means adjacent one another to divide said playing field means into two substantially equal halves, in which said first and second second restricted areas are in the substantial shape of halves of elliptical rings about the outer edges of said first and second serving areas, in which each said first and second first restricted areas are in the shape of a half of a circle with said first and second goal means located at the substantial center of the respective circle, in which said first and second shot-blocking areas are in the shape of halves of annular rings about the outer edge of said first and second restricted areas respectively, and in which said first and second shooting areas are in the shape of halves of annular rings about the outer edge of said first and second shot-blocking areas respectively.

9. Goal means for being located on the ground and for use in a game which involves first and second opposing teams attempting to score points by throwing a flying disk into said goal means; said goal means comprising a hollow body member, said body member including a skeletal frame and including a netlike cover, said frame and said cover coacting to define a single substantially enclosed cavity, said cover having a first opening adjacent the uppermost portion of said skeletal frame, said first opening being of a shape which allows a flying disk to be thrown therethrough, said cover contacting the ground for preventing the flying disk from passing into or out of said cavity beneath said cover.

10. The goal means of claim 9 in which said netlike cover has a second opening adjacent the forwardmost portion of said skeletal frame, said second opening being of a shape which allows a flying disk to be thrown therethrough.

11. The goal means of claim 9 in which said skeletal frame includes a cross-bar member substantially centered beneath said first opening, and in which said netlike cover includes a netlike portion attached to said cross-bar member and to other portions of said skeletal frame for effectively reducing the size of said first opening.

* * * * *